US008167745B2

(12) United States Patent
Britto et al.

(10) Patent No.: US 8,167,745 B2
(45) Date of Patent: May 1, 2012

(54) POLYMER BASKETBALL BACKBOARD

(75) Inventors: Eric S. Britto, Fairhaven, MA (US); Wayne D. Newton, Fairhaven, MA (US)

(73) Assignee: TrueBounce, Inc., New Bedford, MA (US)

( * ) Notice: Subject to any disclaimer, the term of this patent is extended or adjusted under 35 U.S.C. 154(b) by 1591 days.

(21) Appl. No.: 10/274,301

(22) Filed: Oct. 18, 2002

(65) Prior Publication Data

US 2003/0216195 A1 Nov. 20, 2003

Related U.S. Application Data

(60) Provisional application No. 60/380,335, filed on May 14, 2002.

(51) Int. Cl.
*A63B 63/08* (2006.01)

(52) U.S. Cl. ..... 473/481

(58) Field of Classification Search ..... 473/481–483, 473/479, 472, 476
See application file for complete search history.

(56) References Cited

U.S. PATENT DOCUMENTS

| | | | | |
|---|---|---|---|---|
| 2,363,634 | A * | 11/1944 | Albach et al. | 473/481 |
| 2,986,395 | A * | 5/1961 | Sheftel | 473/483 |
| 3,233,898 | A * | 2/1966 | Sheets et al. | 473/481 |
| 5,163,676 | A * | 11/1992 | Taub | 473/483 |
| 5,839,982 | A * | 11/1998 | Hying et al. | 473/481 |
| 6,053,825 | A * | 4/2000 | Allen et al. | 473/479 |
| 6,575,853 | B1 * | 6/2003 | O'Neill et al. | 473/481 |
| 2003/0216195 | A1 * | 11/2003 | Britto et al. | 473/481 |

FOREIGN PATENT DOCUMENTS

FR 2706778 A1 * 6/1993

OTHER PUBLICATIONS

Webpage, Truebounce backboard product description, 2002, www.truebouncebackboards.com/prod01.htm, 3 pages.*
Webpage, Cannonsports product page, www.cannonsports.com, Aug. 6, 2002, 1 page.*
Web Page, Ametco, Perforated Plastic, Feb. 9, 1999,www.ametco.com/perfplastic/index.html,4pages.*
Web Page, TrueBounce web page, downloaded from web Jun. 10, 2005, http://www.truebounce.com/tbstory.htm, 3 pages.*
Product listing for "Anti-vandalism perforated plate backboard minibasket," downloaded from http://www.mondoiberica.es/MondoENG/Catalogo/Baloncesto/PK880.htm, on Jul. 31, 2002, p. 1.
Product listing from e.m.d., downloaded from http://www.emd.es/ingles/baloncesto/i_tableros.htm, on Jul. 31, 2002, p. 1.
Product listing from Hot Shot Sports Equipment, downloaded from http://www.hotshot-sports.com/basketball.htm, on Jul. 31, 2002, pp. 1-2.
Article downloaded on Jul. 31, 2002 from the Standard Times, SouthCoast Today.com, titled, "A better bounce," published on Apr. 23, 2002, p. 1-3.
Product listing downloaded from www.cannonsports.com/pdfdoc/2002%20catalog%20pdf's/02%20p23-46.pdf, on Jul. 31, 2002, p. 1.

* cited by examiner

*Primary Examiner* — Gene Kim
*Assistant Examiner* — M Chambers

(57) ABSTRACT

An indoor basketball backboard is provided lhat makes it easier for players to use the backboard to score baskets. The indoor backboard includes a plurality of voids to adjust a bounce characteristic of the backboard. A basketball backboard having a plurality of voids has bounce characteristics less than that of existing solid backboards. Such backboard may be a polymer backboard or a backboard made from one or more other materials.

24 Claims, 7 Drawing Sheets

| |
|---|
| FIG. 4A |
| FIG. 4B |
| FIG. 4C |

POLYMER BASKETBALL BACKBOARD

RELATED APPLICATIONS

This application claims the benefit under 35 U.S.C. §119 (a) to commonly-owned U.S. provisional patent application Ser. No. 60/380,335, entitled A PERFORATED BASKETBALL BACKBOARD, filed on May 14, 2002.

BACKGROUND

Basketball is a sport played throughout the world. Although the rules, the number of players, and the size of the playing court (if any) may vary, two things remain fairly constant—the use of a ball and the use of a basketball goal assembly. As used herein a "basketball goal assembly" is an assembly comprising a backboard and a basketball rim (i.e., a rim) affixed to the backboard. Typically, the backboard and rim are arranged so that a ball (e.g., a basketball) may be thrown against the backboard, deflect off of the backboard and pass through the rim, resulting in a "basket" (i.e., a goal or score).

As used herein, a "backboard" or "basketball backboard" is a device having a substantially planar surface, e.g., one surface of a board or sheet, configured to be used as part of a basketball goal assembly. The substantially planar surface of a backboard typically faces substantially perpendicular to the playing surface on which a basketball game is being played. As used herein, a "playing surface" is the surface upon which the players in a basketball game play the game, for example, a wood surface, a dirt surface, a concrete surface, a rubber surface, a polymer surface or another type of surface.

A rim (i.e., basketball goal, hoop or basket) includes a ring, typically made out of metal, where the opening of the ring is substantially parallel to the playing surface and perpendicular to the backboard.

Backboards may be made out of a variety of materials, including wood, metal or any of a variety of polymers, including, but not limited to, acrylic, fiberglass, safety glass, and polycarbonate. Basketball may be played indoors or outdoors (typically when the weather is appropriate). Typically, for outdoor, public basketball facilities, backboards are made out of metal, because it is relatively durable and cheap compared to other basketball backboard materials. To save on cost, such basketball backboards typically are relatively thin and are affixed to the ground by one or more poles, for example, a "goose neck" pole, which is a pole that extends upward, perpendicular to the ground or other surface by which it is supported, to a point at which it bends and then extends laterally (parallel to the surface to which it is affixed) and meets the back of the backboard perpendicularly to the planar surface of the backboard. A problem that has been encountered with these outdoor, thin, metal backboards is that they are susceptible to movement in response to wind. This susceptibility to wind becomes a bigger problem as wind velocity increases. A moving backboard typically is not desired as it increases the difficulty in scoring baskets.

To overcome this problem, outdoor metal backboards have been made with perforations that allow the wind to pass through the backboard, thereby reducing the amount that the backboard will move in response to the wind.

SUMMARY

In an embodiment, a basketball backboard comprises a polymer sheet constructed and arranged to serve as a basketball backboard and including a plurality of voids, none of which are for affixing a basketball rim or a support mechanism to the polymer sheet. The voids reduce a bounce characteristic of a region of the polymer sheet as compared to a bounce characteristic of an otherwise identical region of a polymer sheet having no voids.

In an aspect of this embodiment, a ratio of total volume of the one or more voids within the region to the volume of the polymer within the region is in a range from approximately 0.01 to 0.3.

In another aspect of this embodiment, the polymer sheet has at least two distinct regions that have different bounce characteristics.

In another aspect of this embodiment, the polymer sheet has at least three distinct regions, a region on a left side of the polymer sheet that includes one or more of the plurality of voids, a region on a right side of the polymer sheet that includes one or more of the plurality of voids, and a region along a center of the polymer sheet that does not include any voids.

In yet another aspect of this embodiment, the basketball backboard is fixed relative to a basketball rim, and the polymer sheet is configured such that a bounce characteristic of each region of the polymer sheet is a function of a distance of the region from the rim.

In another aspect of this embodiment, the polymer sheet comprises polycarbonate.

In another aspect of this embodiment, one or more of the voids are perforations extending from a front surface of the polymer sheet to a back surface of the polymer sheet. In a feature of this aspect, one or more of the perforations are cylindrical.

In yet another aspect of this embodiment, the voids are arranged in a two-dimensional diagonal pattern.

In another aspect of this embodiment, a front surface of the polymer sheet has an area of at least three square-feet.

In another aspect of this embodiment, the basketball backboard is part of a basketball court housed indoors.

In another aspect of this embodiment, the polymer sheet extends to an entire perimeter of the basketball backboard.

In yet another aspect of this embodiment, the polymer sheet has a front surface that is a front surface of the backboard and a back surface that is a back surface of the backboard.

In another embodiment of the invention, a basketball backboard comprises a polymer sheet configured and arranged to serve as a basketball backboard and including one or more regions that include a plurality of cylindrical perforations extending from a front surface of the polymer sheet to a back surface. Each perforation has an approximately circular cross section that has a diameter of approximately one half inch, and, in each region, the perforations reduce a bounce characteristic of the region as compared to a bounce characteristic of an otherwise identical region having no perforations. None of the plurality of perforations in any of the regions are for affixing a basketball rim or a support mechanism to the polymer sheet.

In another embodiment, a basketball backboard is made. A polymer sheet is configured and arranged to serve as a basketball backboard is provided. A plurality of voids are created in a region of the polymer sheet to reduce a bounce characteristic of the region, where none of the plurality of voids are for affixing a basketball rim or a support mechanism to the polymer sheet.

In an aspect of this embodiment, for a region of the polymer sheet that includes one or more of the voids, a ratio of total volume of the one or more voids within the region to the volume of the polymer within the region is configured to be in a range from approximately 0.01 to 0.3.

In another aspect of this embodiment, the polymer sheet is configured to have at least two distinct regions that have different bounce characteristics.

In another aspect of this embodiment, the polymer sheet is configured to have at least three distinct regions, a region on a left side of the polymer sheet that includes one or more of the plurality of voids, a region on a right side of the polymer sheet that includes one or more of the plurality of voids, and a region along a center of the polymer sheet that does not include any voids.

In yet another aspect of this embodiment, a basketball rim is fixed relative to the backboard, and the polymer sheet is configured such that a bounce characteristic of each region of the polymer sheet is a function of a distance of the region from the rim.

In another aspect of this embodiment, the polymer sheet comprises polycarbonate.

In another aspect of this embodiment, one or more of the voids are created as perforations that extend from a front surface of the polymer sheet to a back surface of the polymer sheet. In a feature of this aspect, one or more of the perforations are configured to be cylindrical.

In yet another aspect of this embodiment, the voids are arranged in a two-dimensional diagonal pattern.

In another aspect of this embodiment, a front surface of the polymer sheet is configured to have an area of at least three square-feet.

In another aspect of this embodiment, the backboard is mounted as part of a basketball court housed indoors.

In yet another embodiment, a basketball court located indoors comprises a basketball backboard including a sheet of material having a plurality of voids in a region of the sheet, none of which are for affixing a rim or a support mechanism to the sheet. The voids reduce a bounce characteristic of the region of the polymer sheet as compared to a bounce characteristic of an otherwise identical region of a polymer sheet having no voids.

In an aspect of this embodiment, the sheet comprises a polymer.

In another aspect of this embodiment, the sheet comprises polycarbonate.

In another aspect of this embodiment, a ratio of total volume of the one or more voids within the region to the volume of the polymer within a the region is in a range from approximately 0.01 to 0.3.

In another aspect of this embodiment, the sheet has at least two distinct regions that have different bounce characteristics.

In yet another aspect of this embodiment, the sheet has at least three distinct regions: a region on a left side of the sheet that includes one or more of the plurality of voids, a region on a right side of the sheet that includes one or more of the plurality of voids, and a region along a center of the sheet that does not include any voids.

In another aspect of this embodiment, the basketball backboard is affixed to a rim, and the sheet is configured such that a bounce characteristic of each region of the sheet is a function of a distance of the region from the rim.

In another aspect of this embodiment, one or more of the voids are perforations extending from a front surface of the sheet to a back surface of the sheet. In a feature of this aspect, one or more of the perforations are cylindrical.

In another aspect of this embodiment, the voids are arranged in a two-dimensional diagonal pattern.

In yet another aspect of this embodiment, a front surface of the sheet has an area of at least three square-feet.

In another aspect of this embodiment, the basketball backboard is part of a basketball court housed indoors.

In another aspect of this embodiment, the sheet extends to an entire perimeter of the basketball backboard.

In another aspect of this embodiment, the sheet has a front surface that is a front surface of the backboard and a back surface that is a back surface of the backboard.

Other advantages, novel features, and objects of the invention, and aspects and embodiments thereof, will become apparent from the following detailed description, when considered in conjunction with the accompanying drawings, which are schematic and are not intended to be drawn to scale. In the figures, each identical or nearly identical component that is illustrated in various figures is represented by a single numeral. For purposes of clarity, not every component is labeled in every figure, nor is every component of each embodiment or aspect of the invention shown where illustration is not necessary to allow those of ordinary skill in the art to understand the invention.

DETAILED DESCRIPTION

Figure 1:
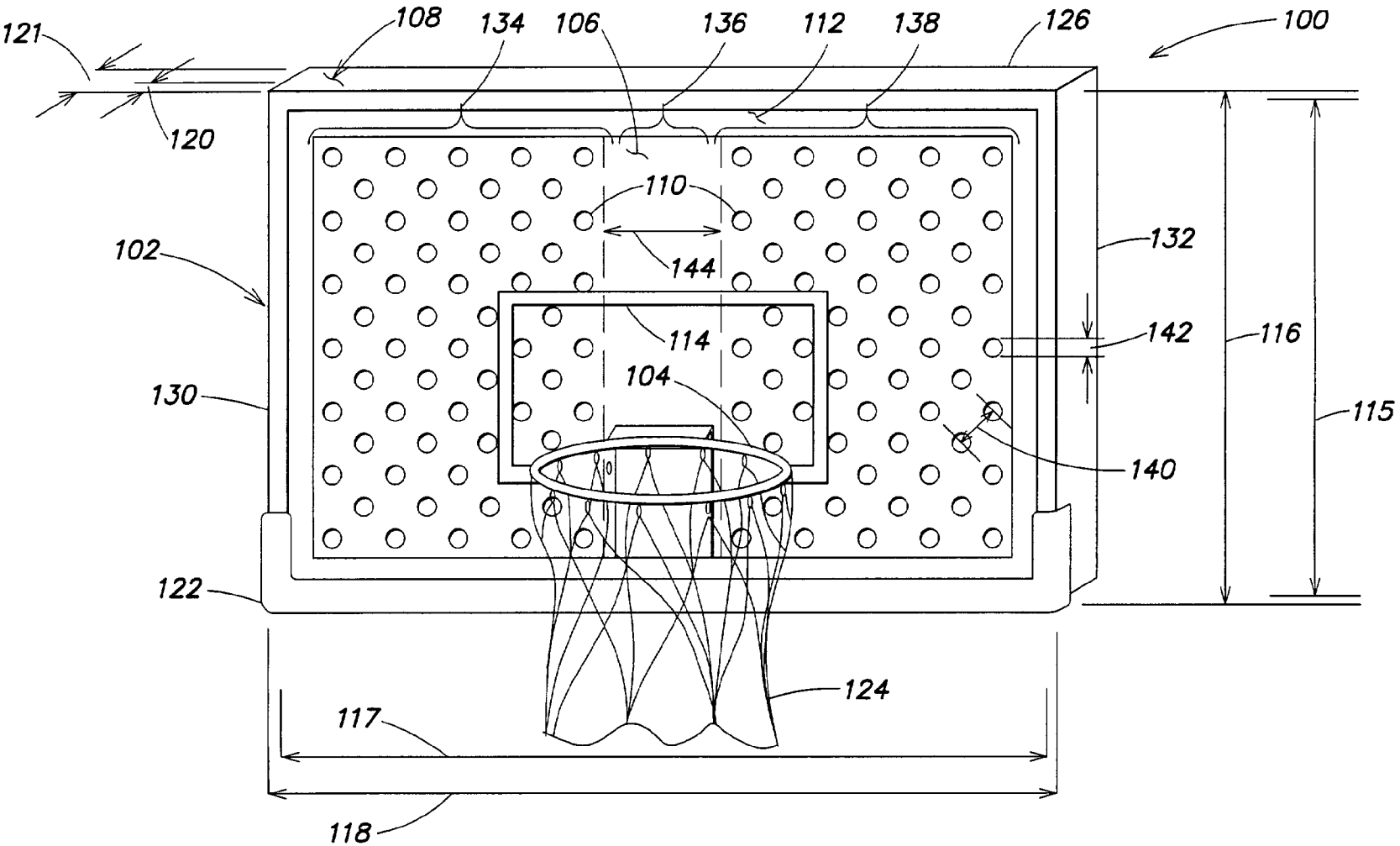
FIG. 1 is a diagram illustrating an example of a front perspective view of a basketball goal assembly including a polymer backboard having voids.

Although the systems and methods described below are described primarily in relation to polymer backboards, the systems and methods described herein are not limited thereto, but may be applied to backboards made from other materials, for example, one or more types of metals or woods or combinations of wood, metal and polymer. As used herein, "metal" includes any material classified as a metal in the periodic table of elements, combinations of such metals, metal alloys including any such metals, and any combination thereof.

In recent years, it has been observed that the average score of a regulation basketball game in the National Basketball Association (NBA) has been decreasing. Many theories have been proposed as to the reason for this scoring decrease, including better defense and more conservative offensive strategies. One theory is that scoring has decreased as a result of the overall poorer shooting ability of the players in recent years. Some also believe that overall shooting ability has declined in recent years at the collegiate level, and possibly at all levels of basketball.

Typically, to increase scoring in the NBA or at the collegiate level, league officials have changed the rules of the game to facilitate higher scoring. For example, certain defenses are banned, a three-point shooting line is installed and/or moved closer to the basket and/or a shot clock is implemented specifying a time limit by which a team must shoot the ball after obtaining possession of the ball.

Applicants have observed that as shooting ability has declined, so seemingly has the tendency to use the backboard when shooting the ball, particularly from within close range to the basket, for example, from zero to ten feet (on a horizontal plane) from the basket. Applicants attribute this reluctance to the fact that shooters today lack the "touch" to use the backboard and, therefore, try to shoot the basketball through the rim without using the backboard. What is meant by "lack of touch" is the lack of ability to throw the basketball off the backboard soft enough or otherwise appropriately so that the ball goes through the rim, as opposed to bouncing off the rim or missing the rim all together.

Accordingly, Applicants have recognized the need to make it easier for players, particularly poorer shooters, to use the backboard to score baskets.

In one aspect of the invention, a basketball backboard is provided that makes it easier for players to use the backboard to score baskets. Applicants have discovered that by reducing the amount of bounce (i.e., rebound or deflection) off of a backboard by a ball (or other object) in response to impacting the backboard, it is more likely that the ball will pass through the rim, which (other factors being equal) results in improved shooting and more scoring in a basketball game. As used herein, a "bounce characteristic" of a region (e.g., a region of a backboard) is an amount of bounce away from an area of the region by an object (e.g., a basketball) in response to the object impacting the area. Thus, reducing the bounce characteristic of one or more regions of a backboard may make it easier for players to score using the backboard. Increasing scoring typically makes the game more enjoyable to players (e.g., when shooting) and often increases fan enjoyment in watching a basketball game.

In another aspect of the invention, a basketball backboard (e.g., a polymer backboard) having a bounce characteristic less than that of existing backboards (e.g., typical polymer backboards) is provided. This reduced bounce characteristic may increase the likelihood that a ball rebounding off of the backboard will pass through the rim.

In one aspect of the invention, a backboard includes a plurality of voids to adjust a bounce characteristic of the backboard. The inventors have found that providing voids in a region of a polymer sheet of a backboard reduces the bounce characteristic of the region compared to a polymer backboard not having voids. Without wanting to be tied to any particular theory, it is believed that the bounce characteristic is so reduced because more of the energy of the basketball or other object is absorbed by the sheet in response to the basketball impacting the sheet than is otherwise absorbed if voids are not present in the sheet.

Thus, in one aspect, a polymer backboard sheet including a plurality of voids is provided. As used herein, a "polymer backboard sheet" is a polymer sheet used as part of a backboard.

In one aspect of the invention, the bounce characteristic of a region of a polymer sheet may be adjusted as a function of a void ratio in the region. Applicants have found that, other factors being equal (e.g., the velocity of an object when impacting a polymer backboard sheet, the angle at which the object impacts the sheet, the spin on the object as it impacts the sheet, the material, if any, used to fill the void, etc.) for a region of a polymer sheet comprising one or more voids, as the ratio of the total volume of the voids in the region to the volume of the polymer within the region increases, the bounce characteristic of the region decreases. The ratio of a total volume of one or more voids within a region of a polymer backboard sheet to the volume of the polymer itself within such region is referred to herein as a "void ratio" of the region. Thus, the bounce characteristic of a region of a polymer sheet may decrease as the void ratio of the region increases, and vice versa. It is believed that the bounce characteristic of a polymer backboard sheet decreases as the void ratio of the region increases because the absorption of energy by the region increases as the void ratio increases. It should be appreciated, however, that there may be a limit to the void ratio with which to configure a polymer backboard sheet, after which limit the structural integrity of the polymer backboard sheet may be compromised.

In yet another aspect, the bounce characteristic of a region of a polymer sheet may be controlled by controlling the size, shape and/or orientation of one or more voids in the region, as will be described in more detail below. Thus, although two otherwise identical regions may have the same void ratio, the bounce characteristic of the region may be different based on the size, shape, and/or orientation of one or more voids within the region.

In another aspect, the bounce characteristics of different regions of a polymer sheet may be different. For example, the bounce characteristics of the such regions may be controlled to be different by controlling the void ratios within such regions and/or controlling the size, shape, and/or orientation of voids within such regions. In an aspect of the invention, a polymer backboard sheet may be configured such that a bounce characteristic of the polymer backboard sheet increases as a function of distance away from a rim fixed relative to the polymer backboard sheet, as will be described below in more detail.

It will be understood that voids in a polymer backboard may be formed in any suitable way. One or more voids in a polymer backboard may be enclosed within the polymer sheet, may extend a finite distance from a surface of the polymer sheet into the polymer sheet, or may extend from one surface of the polymer sheet to another surface of the polymer sheet. A void that extends from one surface of the polymer sheet to another surface of the polymer sheet is referred to herein as a "perforation."

One or more voids of the polymer sheet may be empty (i.e., a vacuum or air-filled) or filled, at least partially, with one or materials that reduce the bounce characteristic of the region of the sheet in which the one or more voids are located.

In an embodiment of the invention, a polymer backboard including a polymer sheet having a plurality of voids (e.g., perforations) is provided, where the voids reduce a bounce characteristic of the polymer sheet as compared to a bounce characteristic of an otherwise identical polymer sheet not having voids, and where none of the plurality of voids are for affixing a rim or support mechanism to the backboard. Such a backboard may be mounted indoors (i.e., in an indoor facility) or outdoors (not in an indoor facility), for example, as part of a basketball court. As used herein, a "basketball court" comprises a playing surface and at least one basketball goal assembly.

In another embodiment of the invention, a polymer backboard including a polymer sheet is made, where a plurality of voids are created in a region of the polymer sheet for use as part of the polymer backboard to reduce a bounce characteristic of the region, and where none of the plurality of voids are for affixing a rim or a support mechanism to the backboard.

In another embodiment, an indoor facility for playing basketball is provided, where the indoor facility includes a basketball court including a basketball goal assembly having a backboard including a sheet of material that has a plurality of voids not used for affixing a rim or support mechanism to the backboard. Such backboard may be a polymer backboard or a backboard made from one or more other materials. As used herein, an "indoor facility" is a housing of any sort (e.g., a building, a house, a garage, a gymnasium, an arena, an athletic dome, a tent, or other facility) that provides adequate protection from the environmental conditions, such as naturally occurring wind.

It should be appreciated that voids of a polymer sheet are more than mere imperfections in the polymer sheet that may result from the manufacturing of the sheet. One or more voids of the polymer sheet may have a volume of at least approximately 0.002 cubic inches, approximately 0.02 cubic inches, approximately 0.125 cubic inches, approximately 1.0 cubic inch or any of a variety of other volumes.

The function and advantage of these and other embodiments of the present invention will be more fully understood from the examples described below. The following examples are intended to facilitate an understanding of aspects of the invention in such a manner that any person skilled in the art of making and using basketball backboards would understand how to practice the invention in the best mode contemplated by the inventors, but such examples do not represent the full scope of the invention.

Examples

FIG. 1 is a diagram illustrating an example of a basketball goal assembly 100, including a polymer backboard 102 having voids 110 and a rim 104. The rim 104 may be made of any of a plurality of materials, including any of a plurality of types of metals, for example, steel or another metal alloy.

The polymer backboard 102 may comprise a polymer sheet 106 having voids 110 and a frame 108. The polymer sheet 106 may be made of any of a plurality of polymers. As used herein, "polymers" include, but are not limited to, plastics, polyesters, acrylic, various types of safety glass, fiberglass, polycarbonate, composites including polymer components and combinations thereof, and do not include metals or metal alloys. A polycarbonate is a long chain linear polyester of carbonic acid and dihydric phenols, for example, bisphenol. Polycarbonate is naturally transparent, with the ability to transmit light that is nearly the ability of glass. It has relatively high strength, toughness, heat resistance, and excellent dimensional and color stability. Flame retardants can be added to polycarbonate without significant loss of properties. Some of the properties of polycarbonate may include: excellent physical properties, excellent toughness, very good heat resistance, fair chemical resistance, transparency, moderate to high price, and fair processing. Polycarbonate has an impact strength approximately twice that of polyvinylchloride (PVC) and approximately five times that of acrylic.

The backboard 102 may have any of a variety of dimensions (e.g., heights 116, widths 118, and thickness 120). Such dimensions may be selected based on a variety of factors, including the cost of materials to prepare the backboard, the intended use and location for the backboard (e.g., indoor, outdoor, home use, official league use, NBA use, collegiate use, high school, by children, by men, women, etc.), the resistance to shattering afforded by the dimensions for the material with which the backboard is made, the strength provided by such dimensions, the weight provided by such dimensions, the cost resulting from such dimensions, the affect such dimensions have on the bounce characteristic of a basketball or other types of balls when impacting the backboard, the cost of making voids 110 resulting from such dimensions, the durability provided by such dimensions, the affect on impact strength of such dimensions, several other factors, or any combinations thereof.

Backboard 102 have a rectangular shape, the general shape of a rectangle with rounded corners, a semi-oval shape or half-moon shape or any other suitable shape. For any shape, the backboard 102 may have any of a variety of dimensions. The shape, width and height of backboard 102 may affect the angle at which someone can shoot a ball at the backboard and have any chance of the ball passing through the rim.

If rectangular, the backboard 102 may have any of a variety of width-by-height dimensions, for example, seventy-two inches by forty-two inches, which is the NBA regulation size, seventy-two inches by forty-eight inches, fifty-four inches by thirty-four inches, fifty-four inches by thirty-eight inches, fifty-four inches by forty-two inches, forty-eight inches by thirty-four inches, and even eighteen inches by twenty-four inches or smaller, which may be used as a sort of toy backboard (e.g., for children). The polymer sheet 106 may have a thickness 120 of ½ inches, ⅜ inches, or another thickness. The thickness 120 of the polymer sheet 106 may be determined based on the height 116 and length 118 of sheet 106. For example, for an eighteen inches by twenty-four inches or smaller sheet 106, the thickness 120 may be ⅜ inches or less, and for larger sizes up to seventy-two inches by forty-eight inches, the thickness 120 may be 2 inches or more. The visual transparency of sheet 106 may be controlled, for example, by selecting a particular polymer with which to make the sheet 106.

Accordingly, the plane defined by height 116 and length 118 of polymer sheet 106 (the "major plane") may have any of a variety of areas, ranging from three square feet or smaller up to twenty-four square feet or larger.

The number, size, shape and pattern of the plurality of voids 110 of sheet 106 may vary, and may vary from region to region. Although the two-dimensional shape of all of the voids on the major plane are shown as circular in FIG. 1, any of the voids may have a variety of other two-dimensional shapes, for example, triangular, rectangular, oval-shaped, star-shaped, other polygon shapes, or combinations thereof. Further, the three-dimensional shape of voids 110 may vary as well. For example, the voids 110 illustrated in FIG. 1 may have a cylindrical shape formed by a circular shape on the major plane extending into a third dimension along thickness 120, or any of a variety of other three-dimensional shapes, for example, three-dimensional shapes formed from a two-dimensional shape (e.g., one of the two-dimensional shapes described above) extending into the third dimension along thickness 120. It may be desirable to make the voids 110 approximately cylindrical because a cylindrical shape may be a relatively easy shape of a void to create in the polymer sheet 106. For example, a drill may be used to produce the voids 110, and cylinders are a relatively easy shape to produce with a drill. Further, the shape chosen for one or more of the voids 110 may be chosen based at least in part on aesthetic appeal.

One or more of the voids 110 may be perforations that extend from one surface of the sheet 106 to another surface, for example, from the front surface of sheet 106 to a back surface of sheet 106. The "front surface" of sheet 106 is the surface, aligned along the major plane, that faces the side of the backboard 102 against which rim 104 may be affixed and against which basketballs or other objects may be thrown in an attempt to score a basket. The back surface of sheet 106 is the surface on the opposite side of sheet 106 from the front surface. One or more voids 110 may not extend from one surface of sheet 106 to another surface, but may extend a finite distance from one of the surfaces of sheet 106 into the sheet 106. Alternately, voids 110 may be enclosed within sheet 106, e.g., bubbles within the sheet.

The size of one or more of the voids 110 may be chosen based on any of a variety of factors, for example, the desired void ratio of a volume of the sheet 106 or desired bounce characteristic of such volume, the amount of sound desired to be transmitted through the backboard, the amount of glare from the backboard desired, the relation of the cost to make a void to the size of the void, the visual clarity of the voids at one or more distances from the sheet 106, the overall "look" of the backboard, etc.

The void ratio and, therefore, the bounce characteristic of any region of polymer sheet 106 may be controlled by controlling the size (i.e., volume) of each void and the number of voids within the region. Further, for each region of sheet 106, the bounce characteristic of the region further may be controlled by controlling the material with which each void is filled, if any, and the extent to which each void is filled. For example, each void may be filled with any of a plurality of materials, including air, wood, metal, another polymer, rubber, foam, or any combination thereof, or may be a vacuum.

A region of the polymer sheet 106 may be configured to have any of a variety of void ratios, depending upon a bounce characteristic desired. For example, the void ratio may be configured to have any value within a range from approximately 0.01 to 0.30. These example values for the void ratio are provided for illustrative purposes only, as the polymer sheet 106 may be configured to have any of a variety of void ratios depending upon the desired bounce characteristic. The maximum void ratio may be limited to a value for which the structural integrity of the polymer sheet 106 is not compromised.

Any of a variety of patterns, including two-dimensional patterns (e.g., on the major plane) of the voids 110 may be used. FIG. 1 illustrates a pattern where the voids 110 are arranged in a staggered-row pattern, where the voids of each row do not vertically align with corresponding voids of the immediately adjacent line, but are vertically aligned with the corresponding voids of the row following the adjacent row. FIG. 1 also illustrates a staggered column pattern. Further, the voids 110 of sheet 106 may be aligned diagonally such that a substantially straight line can be drawn diagonally (e.g., at a 45° angle) through the approximate center of voids of three or more consecutive rows of voids. Such a two-dimensional pattern is referred to herein as a "diagonal pattern." An example of a diagonal pattern is illustrated in FIG. 1. The voids 110 may be arranged in any other two-dimensional or three-dimensional pattern, or may be randomly dispersed, and any such voids may have different shapes and sizes.

FIG. 1 illustrates an example of a sheet 106 where the sheet is divided into three sections, side sections 134 and 138 and center section 136. Side sections 134 and 138 each have a uniform distribution of voids arranged in a diagonal pattern. Center section 136 does not include any voids. Each section 134, 136 and 138 extends from a top to bottom of sheet 106, where section 136 borders both sections 134 and 138 (as illustrated with dashed lines). The width 144 of center section 136 may have any of a variety of values, for example, eight inches or eleven inches, where width 144 may be chosen based on aesthetic reasons, desired bounce characteristic in one or more regions of the board, the width 118 of polymer sheet 106, other factors, and any combination thereof.

Voids 110 may be arranged as such for aesthetic reasons, or so that the bounce characteristics of side sections 134 and 138 are less than that of section 136. In fact, the voids 110 may be arranged such that different regions of the polymer sheet 106 have different void ratios and thus different bounce characteristics.

In contrast to the pattern in FIG. 1, it may be desirable to consume less space with voids in regions of the sheet 106 that are farther from the rim 104 than in regions closer to rim 104 such that the bounce characteristic of these farther regions is greater than the closer regions. Accordingly, the ball bounces farther in response to impacting such farther regions (other factors being equal) than in response to impacting closer regions. Bouncing farther may be desirable in such farther regions as the ball has farther to travel to get to the rim 104. Thus, the voids 110 of sheet 106 may be arranged such that the void ratio decreases as a function of distance from the rim 104. In alternative embodiments, the void ratio may be configured differently in different regions of the backboard as a function of one or more other parameters, combinations thereof and combinations including the function of distance from the rim.

Polymer sheet 106 may have a border area on the major plane, extending a distance from each edge of the sheet into the interior of the major plane, where no voids are included within such area. Such distance may have any of a variety of values, for example, four inches, where such distance may be chosen for any of a variety of reasons.

For each region of sheet 106, the voids 110 of such region may be distributed uniformly throughout the region with respect to the major plane, or may have a non-uniform distribution with respect to the major plane.

In an embodiment of sheet 106, one or more regions (e.g., the region defined by section 134 or 138) of sheet 106 may include perforations that are uniformly dispersed with respect to the major plane. Each perforation may have any of a plurality of diameters 142, for example, ½ inches and may have any of a plurality of lengths defined by the thickness 120 of sheet 106, for example, ½ inches or ⅜ inches. Further, in such embodiment, the holes may be arranged in any of a variety of patterns, for example, a diagonal pattern, where diagonally adjacent holes are spaced apart (from a center of one void to a center of another void) by a spacing distance 140, which may be any of a variety of distances, for example, 1½ inches, 1¾ inches, 2 inches, 2¼ inches, or another value. In an aspect of this embodiment, a region (e.g., the region defined by section 134 or 138) may have a plurality of cylindrical-shaped perforations arranged in a diagonal pattern. For such aspect, the void ratio of the region and thus the bounce characteristic of the region are a function of diameter 142 of the perforations and the spacing distance 140 between diagonally-aligned, adjacent perforations. For example, for a perforation diameter 142 of ½ inches and a spacing distance 140 of 1½ inches in a region, the void ratio of the region may be approximately 0.11, and for a region having a perforation diameter 142 of ½ inches and a spacing distance 140 of two inches, the void ratio may be approximately 0.07. The example diameters, spacing distances and void ratios described above are merely for illustrative purposes, as any of a variety of other values may be used for these parameters.

Any of a variety of number of voids 110 may be included within sheet 106. For an embodiment of sheet 106 in which the sheet is rectangular-shaped on the major plane, includes a center section (e.g., center section 136) that does not include any voids, and side sections (e.g., side sections 134 and 138) including a plurality of cylindrical perforations in a diagonal pattern, the number of perforations 110 may vary as a function of the area on the major plane of the side sections, the perforation diameter 142 of the perforations and the spacing distance 140 between the perforations. For example, for a polymer sheet 106 having a width 118 by height 116 dimension of seventy-two inches by forty-eight inches, seventy-two inches by forty-two inches, fifty-four inches by thirty-eight inches or forty-eight inches by thirty-four inches, the amount of holes may be 402, 250, 154 and 190, respectively. The number of perforations for each width-by-height dimension described above serve as examples only, as any of a variety of other numbers of holes may be included within a sheet 106 of rectangular shape having a plurality of cylindrical perforations arranged in a diagonal pattern.

It may be desirable to paint any of a variety of designs on the polymer sheet 106, for example, border region 112 and target region 114. Border region 112 may extend along the perimeter of the sheet 106, and may abut the frame 108. Border region 112 may be painted using any of a variety of colors or combination of colors, although red, white, and/or orange typically are used to paint the border regions of basketball backboards.

Target region 114 is typically found on basketball backboards to help shooters target a region on the backboard for which to aim the basketball. Target region 114 may be painted any of a variety of colors, for example, red orange or white which are typically used to paint the target region of a backboard.

Other designs, including random designs, may be painted on the backboard, for example, logos, images or words.

The frame 108 may be made of four frame pieces, including the top piece 126, the bottom piece 128, and two side pieces 130 and 132, where adjacent pieces may be adjoined at the corners of the backboard 102. Each frame piece may comprise any of a variety of materials, for example, polymers, aluminum, aluminum alloy, steel, or other types and combinations of metals and/or alloys. Further, each frame piece may be formed using any of a plurality of manufacturing techniques, for example, extrusion. Frame pieces will be described below in more detail in relation to method 300.

The sheet 106 may be visually transparent, opaque or have any of a variety of other degrees of visual transparency. Although backboard 102 may be painted or made from a material such that the backboard 102 is visually opaque, it may be desirable to make the backboard 102 visually transparent due to the standard league rules at several levels of basketball, from high school to the professional level. However, it may be desirable to make the backboard visually opaque, for example, by painting the entire backboard, depending on the intended use of the backboard. For example, in many gymnasiums, there is a main basketball court that includes a basketball goal assembly having a visually transparent backboard, and side courts that have basketball goal assemblies that include backboards that are painted white. This visual transparency of sheet 106 may be controlled, for example, by selecting a particular polymer with which to make the sheet 106.

The backboard 102 also may be equipped with any of a variety of standard equipment and apparel typically used with backboards for example, padding 122 (e.g., foam rubber padding).

The rim 104 may be any of a variety of types of rims, for example, single-hoop or double-hoop rim, a rigid or collapsible rim or combinations thereof. The rim may comprise any of a variety of materials, for example, metal, metal alloys, polymers, or combinations thereof. The opening of rim 104 may have any of a plurality of diameters for example, the standard opening diameter of eighteen inches. The rim 104 itself may have any of a plurality of diameters, for example, ⅝ inches. The rim 104 may have a plurality of hooks that allow a net 124 to be mated with the rim 104. The net may be made of any of a variety of materials, for example, nylon or metal (e.g., a chain-link net).

Figure 2:
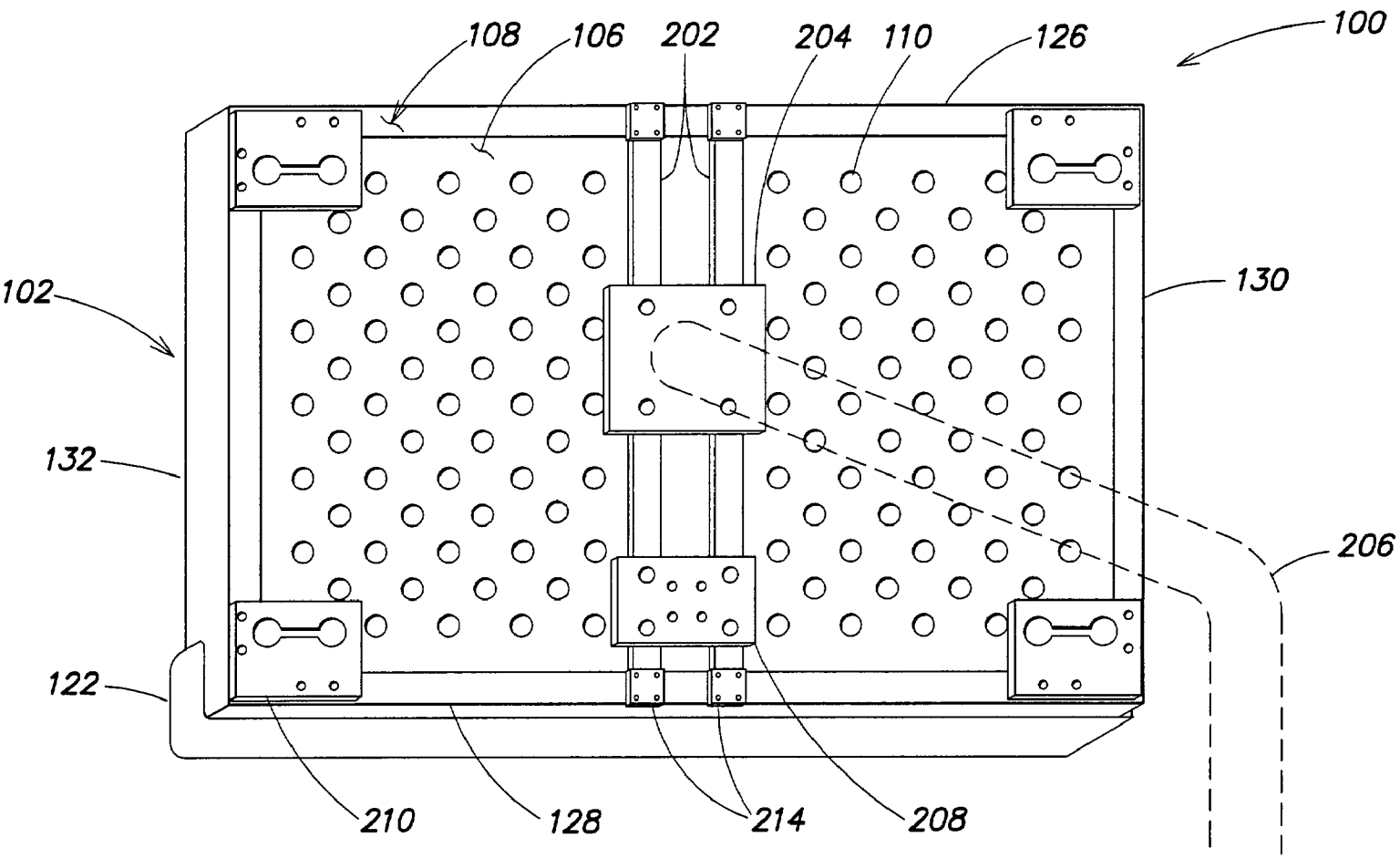
FIG. 2 is a diagram illustrating an example of a rear perspective view of a basketball goal assembly including a polymer backboard having voids.

FIG. 2 is a diagram illustrating an example of a rear perspective view of the basketball goal assembly 100. In addition to the elements described with respect to FIG. 1, the basketball goal assembly 100 also may include support rods 202, a goose-neck plate 204, a rim plate 208, corner brackets (not shown), support rod brackets 214, and corner support brackets 210.

One or more support rods 202 may extend from the top to the bottom to the backboard 102 through the approximate center of width 118 of backboard 102. The support rods may be affixed to a goose neck plate 204 for affixing a goose neck support 206 to the backboard 102, and may be affixed to rim plate 208 for affixing rim 104 to the backboard 102. The support rod brackets 214 may be used to fasten the one or more rods 202 to the frame 108, for example, top and bottom frame pieces 126 and 128.

The support rods 202 may comprise any of a variety of materials, for example, polymers, aluminum, steel, other metals and alloys or any combination thereof. Support rods 202 may be solid or hollow, where whether or not the rods are solid or hollow may depend upon several factors, including costs, durability, weight, etc. In an embodiment, where a goose neck support 206 is not to be used to support the basketball goal assembly 100, support rods 202 may not be included as part of the assembly 100, and rim plate 208 may be affixed directly to polymer sheet 106 or may be affixed to polymer sheet 106 by other means. The goose neck plate 204, the rim plate 208, and support rod brackets 214 may be made of any of a plurality of materials, for example, polymer, aluminum, steel, other metals and alloys, or combinations thereof, and each may have other shapes and sizes other than those illustrated in FIG. 2.

The corner brackets may be used to fasten adjacent frame pieces together at the corners of the backboard 102, and corner support brackets 210 may be used to affix the backboard 102 to four corner supports, for example, supports that connect the backboard 102 to a wall providing support for the basketball goal assembly 100. The corner brackets and corner support brackets 210 may comprise any of a plurality of materials, for example, polymer, aluminum, steel, other metals and alloys, or combinations thereof, and each may have shapes and sizes other than those illustrated in FIG. 2. For example, although corner support brackets 210 are illustrated in FIG. 2 as being a key-way type of bracket, other types of bracket may be used for the corner support bracket.

As discussed above in relation to FIG. 1, frame 108 may include four frame pieces 126, 128, 130 and 132 which may be fastened together at the corners of backboard 102, for example, by use of the corner brackets, welding or other means.

Basketball goal assembly 100 may be mounted using any of a plurality of support systems (not shown). For example, assembly 100 may be mounted using a gooseneck support system or a four-corner support system as described above. One or more supports of such support system may be embedded in the ground, for example, for outdoor courts, may rest on the ground, and/or may be connected to a wall. The support system may be collapsible. For example, one or more supports that are embedded in or resting on the ground may be collapsible such that a basketball goal assembly attached thereto (e.g. assembly 100) may be lowered towards the ground and/or collapsed into a more compact form and/or with the support system. Further, wall-mounted supports also may be collapsible such that an assembly (e.g., assembly 100) that extends from a wall may collapse into the wall.

Basketball goal assembly 100 may be mounted indoors or outdoors, for example, as part of a basketball court. Further, basketball assembly 100 may be mounted over a body of water, for example, on a side of a swimming pool.

Aside from absorbing energy upon impact of an object, there may be other benefits to including voids in the polymer sheet 106. For example, the voids may allow more sound to pass through the sheet 106, which may be desirable for fans seated behind a backboard or for capturing more sound using a microphone, for example, for television or radio, broadcast. Further, the inclusion of voids 110 and sheet 106 may reduce the amount of glare caused by light reflecting off of the sheet 106, which benefits both players and fans alike.

The basketball goal assembly 100 illustrated in FIGS. 1 and 2 and described above is merely an illustrative embodiment of a basketball goal assembly in accordance with an aspect of the invention. Such an illustrative embodiment is not intended to limit the scope of the invention, as any of numerous other implementations of a basketball goal assembly, for example, variations of basketball goal assembly 100, are possible, and are intended to fall within. For example, although the backboard 102 primarily has been described above as having a single polymer sheet 106, backboard 102 may include a plurality of sheets 106, and one or more of these other sheets may comprise any of a plurality of materials, including a polymer, a metal, a wood or combinations thereof. None of the claims set forth below are intended to be limited to any particular implementation of a basketball goal assembly unless such claim includes a limitation explicitly reciting a particular implementation.

Figure 3:
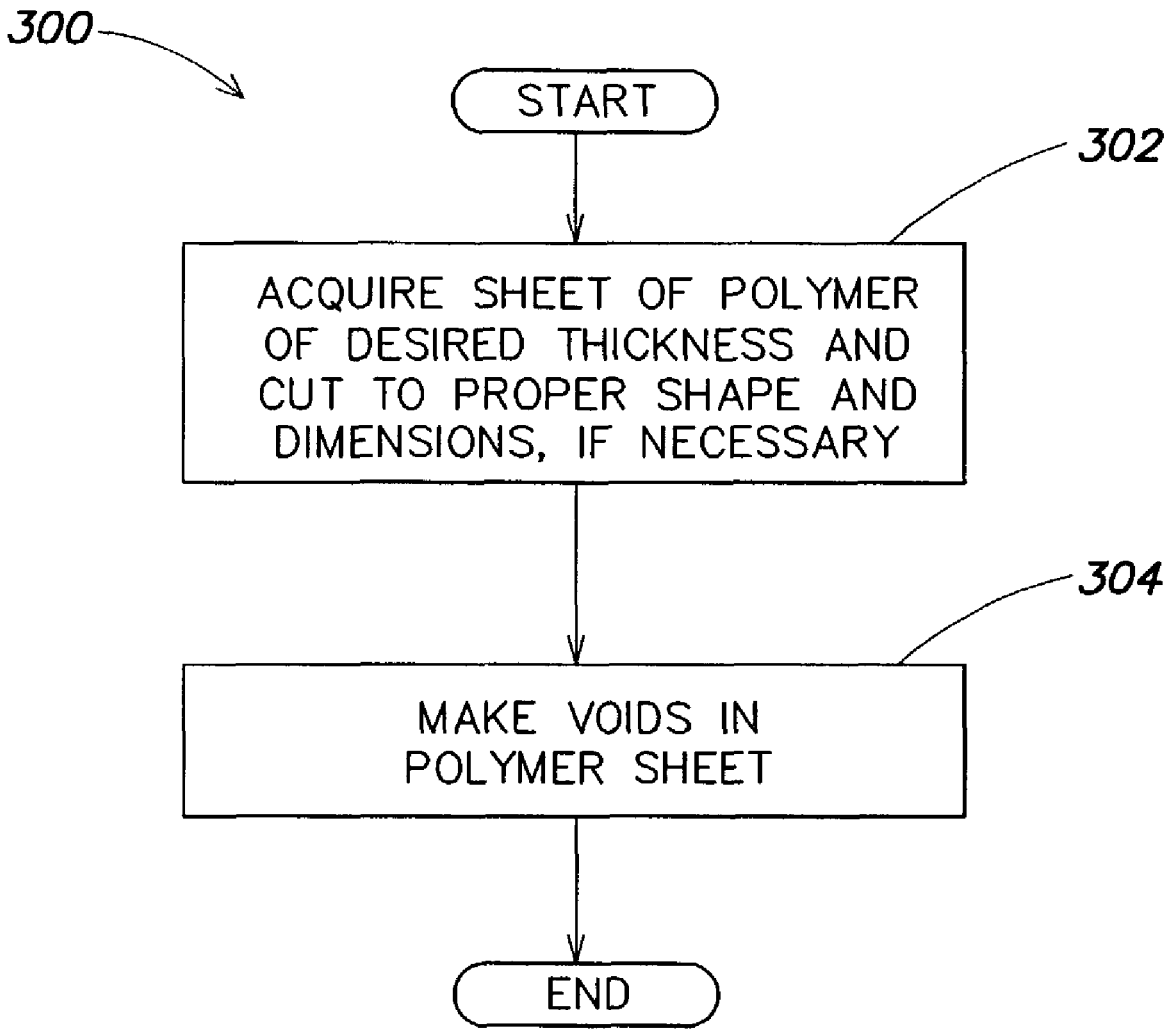
FIG. 3 is a flow chart illustrating an example of a method of creating a polymer sheet having a plurality of voids to be used as part of a basketball backboard and/or a basketball goal assembly.

FIG. 3 is a flow chart illustrating an example of a method 300 of making a polymer sheet having a plurality of voids to be used as part of a basketball backboard and/or basketball goal assembly.

In Act 302, a sheet of polymer of desired thickness may be acquired, and if necessary cut to desired shape and dimensions. The polymer sheet may be configured to have any of the shapes and dimensions discussed above with respect to FIG. 1 using known techniques for configuring polymer sheets.

In Act 304, voids may be made in the polymer sheet, for example, using a drill or press. Each void may extend a finite distance into the polymer sheet or may extend from one surface to another, thus forming a perforation. Voids may be made in the polymer sheet using other techniques as well. For example, if one or more of the voids are to be enclosed within the polymer sheet, one or more of holes may be made in the polymer sheet and then another layer may be added to the polymer sheet to cover-up the holes on one side. This other layer may be another polymer sheet that may itself have holes, and the holes of each sheet may be aligned such that the resulting combined polymer sheet has voids enclosed within. Other techniques may be used to create a polymer sheet with voids enclosed therein. The combination of the sheet and the layer (which may be another sheet) together may form a single sheet (e.g., sheet 106).

Act 304 may include making voids of any of the variety of shapes and sizes discussed above with respect to FIG. 1. Act 304 may further include arranging the voids in any of the variety of patterns discussed above with respect to FIG. 1.

Act 304 further may include configuring the bounce characteristic of one or more regions of the polymer sheet, for example, by configuring the void ratio within the one or more regions and/or controlling the shape of the voids in the one or more regions. Act 304 further may include configuring two or more regions of the polymer sheet to have different bounce characteristics, for example, by configuring the void ratios in these regions and/or the shapes, sizes and orientations of the voids within the regions. For example, Act 304 may include configuring the voids made in the polymer sheet such that the bounce characteristic of one or more regions of the board is a function of the distance of the regions from some other point, area or region of the polymer sheet, for example, the region where a rim is to be attached.

Although Acts 302 and 304 are described as discrete acts above, it should be appreciated that Acts 302 and 304, or parts thereof, may be performed as part of a single act. For example, the voids may be made in the polymer sheet during the manufacturing of the polymer sheet itself using any of a variety of known techniques.

Method 300 is merely an illustrative embodiment of a method of making a polymer sheet having a plurality of voids to be used as part of a basketball backboard and/or basketball goal assembly. Such an illustrative embodiment is not intended to limit the scope of the invention, as any of numerous other implementations of making a polymer sheet having a plurality of voids, for example, variations of method 300, are possible and are intended to fall within the scope of the invention. None of the claims set forth below are intended to be limited to any particular implementation of making a polymer sheet having voids to be used as part of the basketball backboard, unless such claim includes a limitation explicitly reciting a particular implementation.

Method 300 may include additional acts. Further, it should be noted that although method 300 is described primarily in relation to making a polymer sheet having voids, a same or similar technique may be used to make a sheet comprising any of a plurality of other materials, for example, metal or wood or combinations of metal, wood and polymers.

Figure 4A:
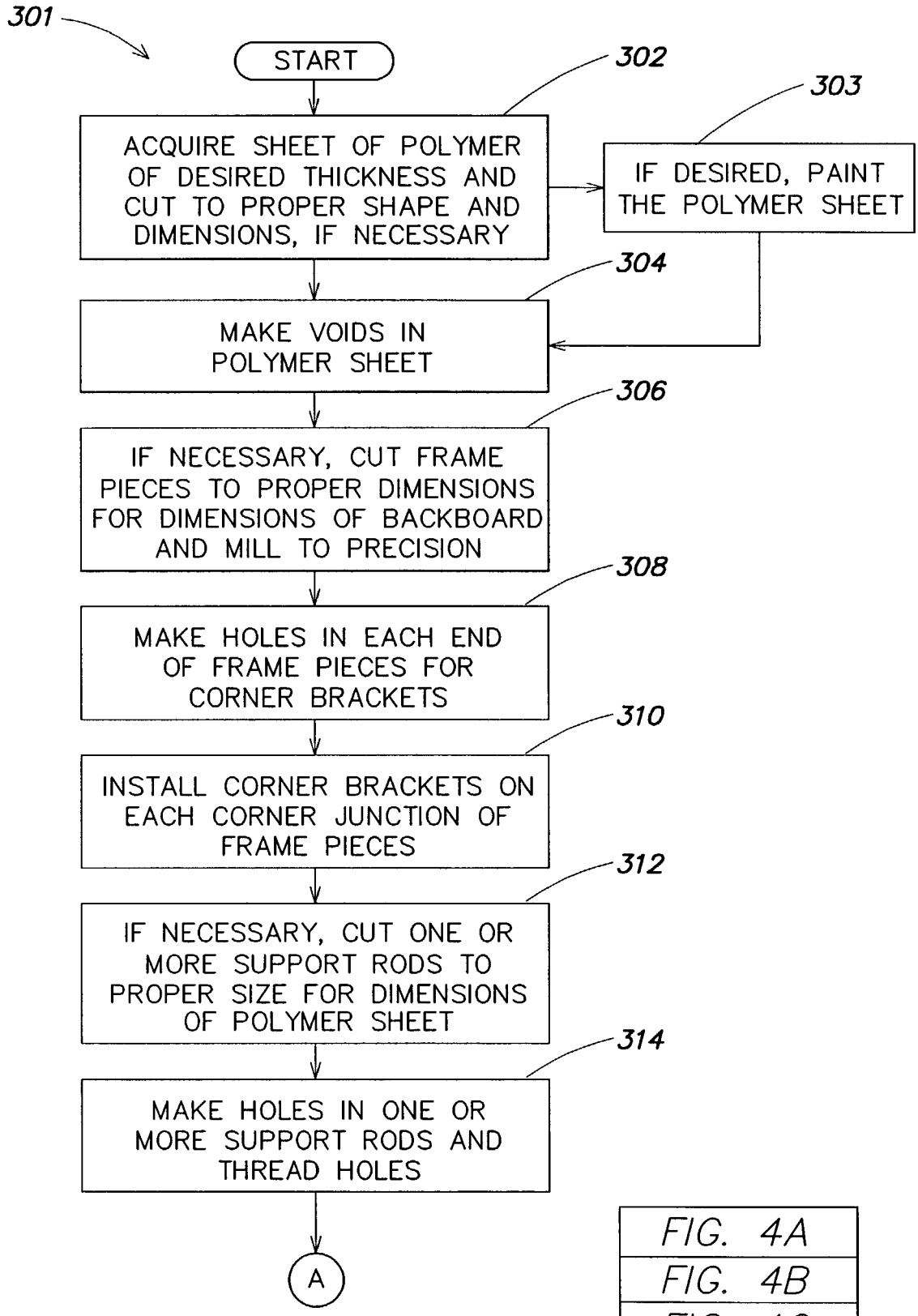
FIGS. 4A-4C are a flow chart illustrating an example of a method of creating a polymer backboard including a polymer sheet having voids.
Figure 4B:
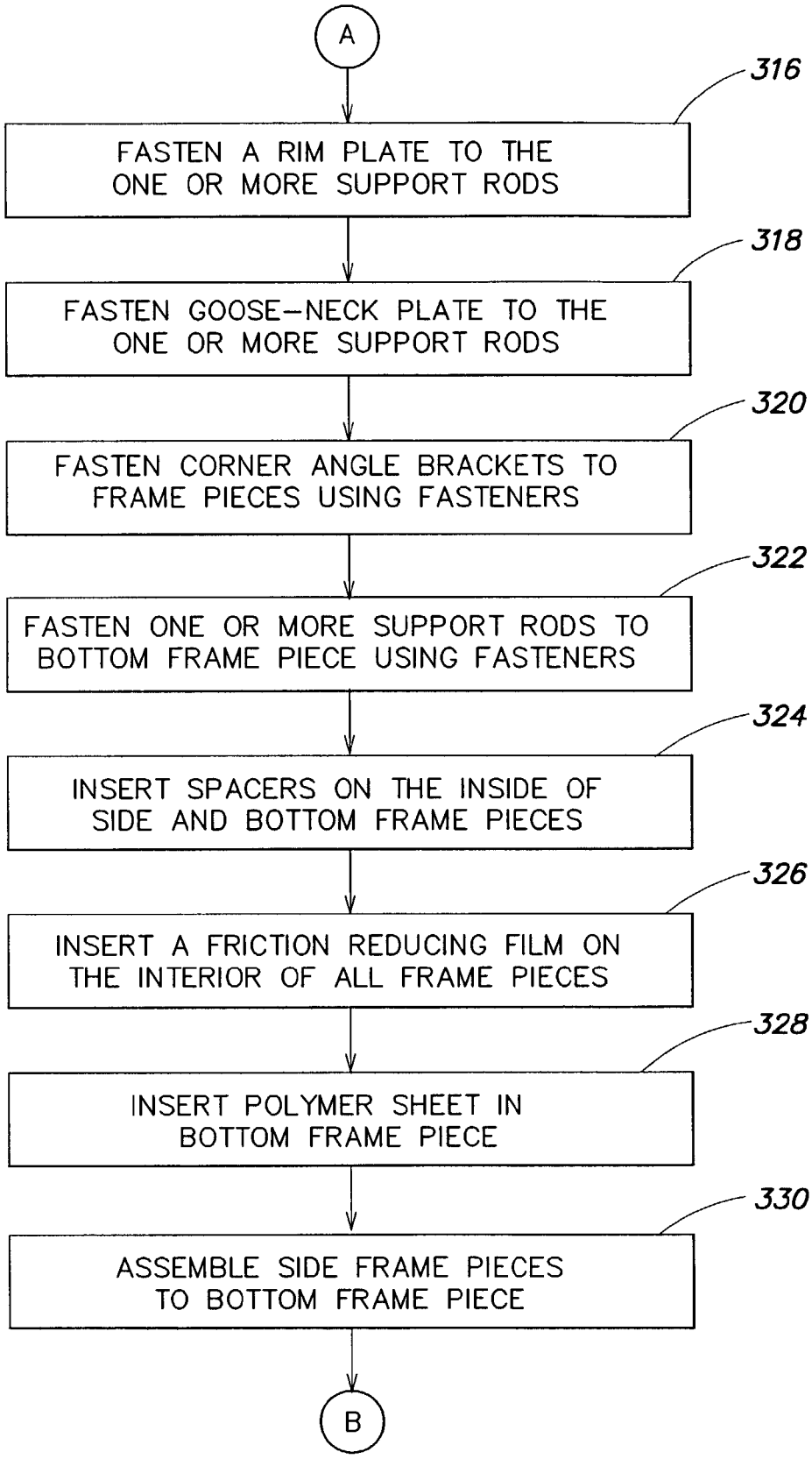
Figure 4C:
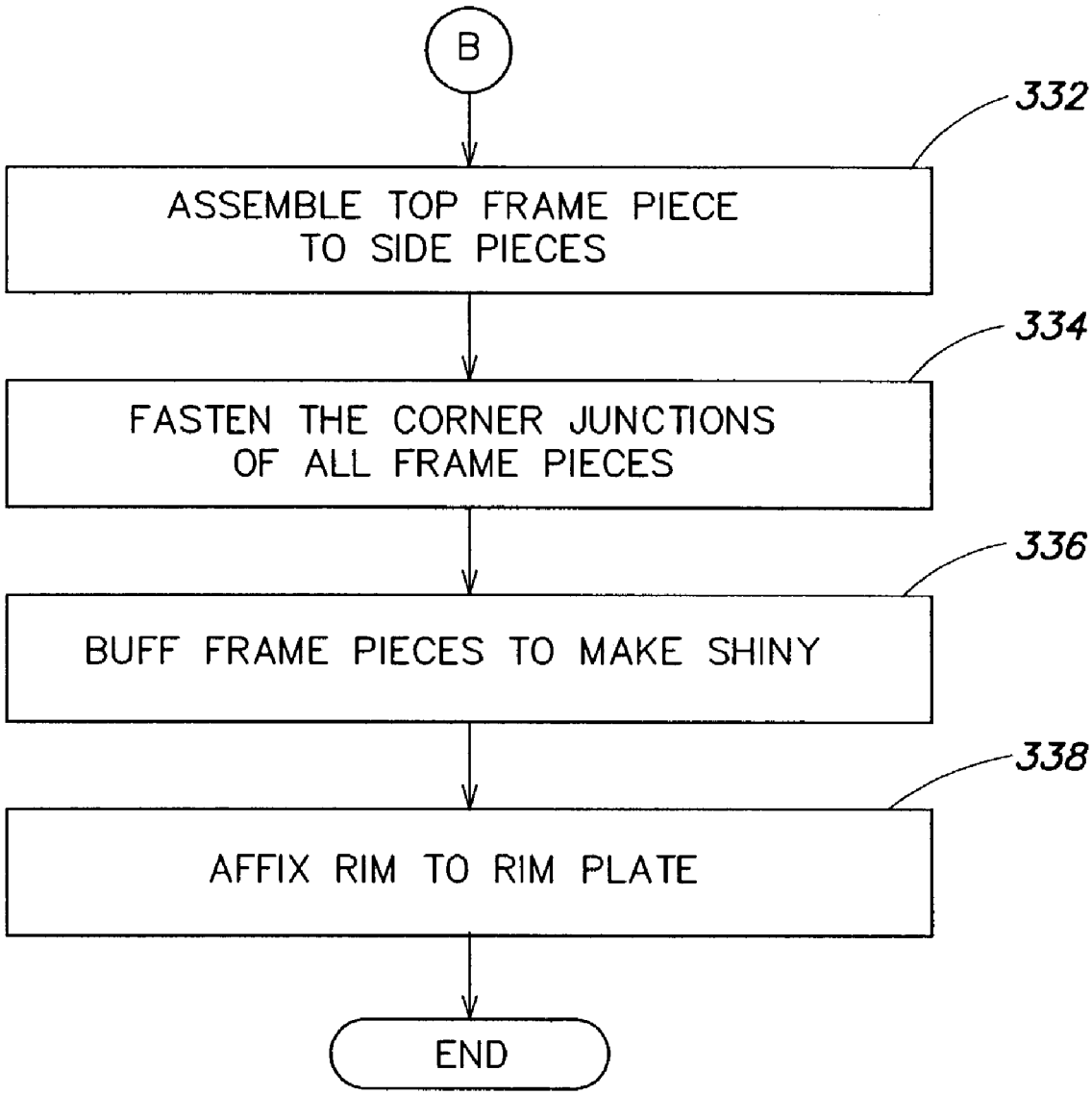

Any of a plurality of methods may be employed to make a basketball backboard and/or a basketball goal assembly (e.g., assembly 100). FIGS. 4A-4C comprise a flowchart illustrating an example of a method 301 of making a basketball backboard (e.g., backboard 102) or a basketball goal assembly (e.g., assembly 100) including a perforated, polymer sheet (e.g., sheet 106).

Acts 302 and 304 of method 301 may be performed as described above with respect to method 300 of FIG. 3. In Act 303, the polymer sheet (e.g., sheet 106) may be painted if desired. It may be desirable to perform Act 303 before Act 304 because it may be easier to paint the polymer sheet before it has several voids (e.g., voids 110) made therein.

In Act 306, if necessary, frame pieces may be cut to proper dimensions for the dimensions of the backboard to be made, and may be milled to precision. Next, in Act 308, holes may be made in each end of the frame pieces (e.g., frame pieces 126, 128, 130 and 132) so that corner brackets may be affixed thereto, and in Act 310 the corner brackets may be installed on each corner where the frame pieces meet (i.e., corner junctions).

In Act 312, if necessary, one or more support rods may be cut to proper size for the dimensions of the polymer sheet, and in Act 314, holes may be are made in the one or more support rods (e.g., support rods 202) and the holes may be threaded.

In Act 316, a rim plate (e.g., rim plate 208) may be fastened to the one or more support rods. The rim plate may have any of a variety of thicknesses, for example, ¼ inches or 5/16 inches, and it may be configured to mate with one or more different types of rims. For example, rim plate 208 may be configured as a universal rim plate such that it can be affixed to any (or nearly any) known type of rim. The rim plate may be fastened to the one or more support rods using any of a variety of known techniques, for example, welding or mechanical means (e.g., screws).

In Act 318, a goose neck plate (e.g., goose-neck plate 204) may be fastened to the one or more support rods. It may be desirable to include a goose-neck plate if it is known that the basketball goal assembly 100 is to be supported by a goose neck support (e.g., goose neck support 206) or if it is desired to have a basketball goal assembly 100 that is capable of being affixed to a goose neck support.

In Act 320, the corner brackets (e.g., corner angle brackets) may be fastened, at least partially, to the frame piece using fasteners, for example, stainless steel fasteners. In Act 322, the one or more support rods may be fastened, at least partially, to the bottom frame piece using fasteners, for example, stainless steel fasteners.

In Act 324, spacers may be inserted on the inside of the side and bottom frame pieces 128, 130 and 132. The spacers serve to provide a cushion between the frame 108 and the polymer sheet 106 to reduce a wear-and-tear in between the sheet 106 and the frame 108 as a result of movement of the backboard 102, for example, in response to wind or objects impacting the backboard 102, rim 104, or support system. The spacers may be made of any of a variety of materials, including rubber, for example, foam rubber.

In Act 326, a friction-reducing material may be inserted into the interior of all the frame pieces 126, 128, 130 and 132 to help reduce friction between the frame pieces and polymer sheet 106 over the life of the backboard 102, such that the interior of all the frame pieces may be lined with the friction-reducing material, for example, EPDM (i.e., Ethylene Propylene) or other eurothanes or silicones, or combinations thereof. For example, referring to FIG. 4, the region defined by spine 402 and legs 406 and 412 may be lined with the friction-reducing material. This material may be adhesive or non-adhesive and may be applied to the frame pieces using any variety of known techniques, for example, by spraying.

In Act 328, the polymer sheet 106 may be inserted into bottom frame piece 128. Next, in Act 330, the side frame pieces 130 and 132 are assembled (i.e., fastened together) to the bottom frame piece 128, for example, using mechanical means such as the corner brackets or alternatively by other means such as welding.

In Act 332, the top frame piece may be assembled to the side pieces, for example, using the corner brackets or by welding. In Act 334, the corner junctions of all frame pieces may be fastened together, for example, using the corner brackets in combination with a stainless steel screw and a nylok cap nut. Alternatively, the four corner junctions could be fastened together using welding.

In a next act (not shown), corner support brackets (e.g., corner support brackets 201) may be affixed to the frame pieces.

In Act 336, the frame pieces may be buffed to make the frame pieces shiny for aesthetic purposes.

In Act 338, the rim 104 (which may be any of a plurality of types of rims) may be affixed to rim plate 208. In another act (not shown), padding (e.g., padding 122) may be attached to the bottom frame piece and the bottoms portion of the side frame pieces.

The holes in rim plate 208 that are used to affix rim 104 may be drilled at any point during method 300 and may be drilled to accommodate one or more types of rim 104. Further, rim plate 208 may be affixed directly to polymer sheet 106 if support rods 202 are not included as part of the basketball goal assembly 100.

A rim, for example 104, then may be affixed to the backboard to produce a basketball goal assembly. The basketball goal assembly then may be mounted indoors or outdoors using any of a variety of types of Support systems, such as those described above.

Method 301 is merely an illustrative embodiment of a method of making a basketball goal assembly including a polymer backboard having voids. Such an illustrative embodiment is not intended to limit the scope of the invention, as any of numerous other implementations of making a basketball goal assembly including a polymer backboard having voids, for example, variations of method 301, are possible and are intended to fall within the scope of the invention. For example, although method 300 illustrates an embodiment of making a backboard or of basketball goal assembly having a rectangular shape, this aspect of the invention is not limited to such embodiment, as basketball backboards and basketball goal assemblies of any of a variety of other shapes may be made using acts of method 301 and variations thereof, and are intended to fall within the scope of the invention. None of the claims set forth below are intended to be limited to any particular implementation of making a basketball goal assembly including a polymer backboard having voids, unless such claim includes a limitation explicitly reciting a particular implementation.

Method 301 may include additional acts. Further, the order of the acts performed as part of method 301 is not limited to the order illustrated in FIGS. 4A-4C as the acts may be performed in other orders, and one or more the acts may be performed in series or in parallel to one or more other acts, or parts thereof. For example, acts 302-304 may be performed before, after or in parallel to acts 306-310 and/or acts 312-314.

It should be noted that although method 301 is described primarily in relation to making a basketball goal assembly including a polymer backboard having voids, a same or similar technique may be used to make a basketball goal assembly including a perforated backboard comprising any of a plurality of other materials, for example, metal or wood or combinations of metal, wood and polymers.

Figure 5:
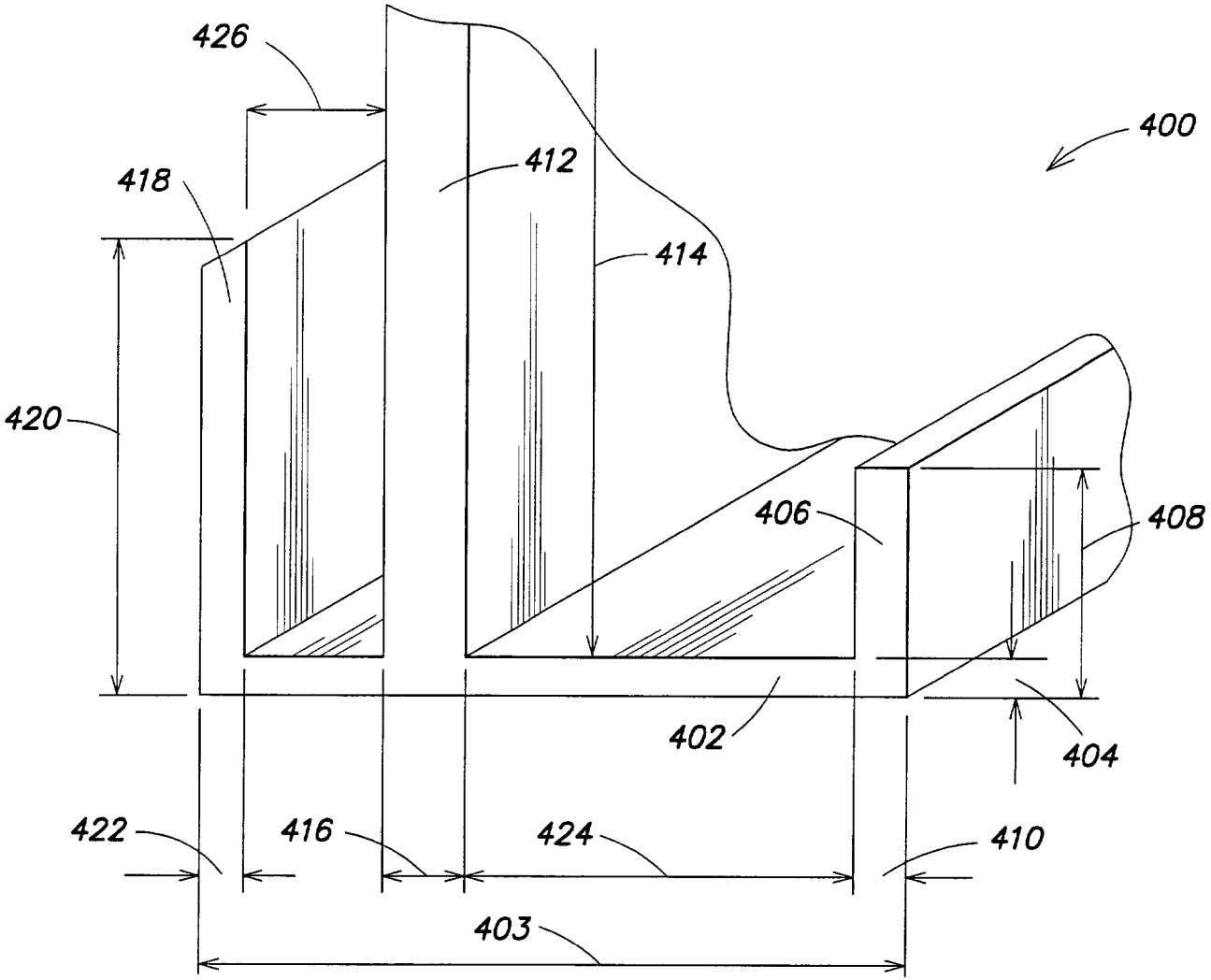
FIG. 5 is a diagram illustrating a cut away portion of an E-type frame piece for a polymer backboard having voids.

FIG. 5 is a perspective view of a cut-away portion of an example of a frame piece that may be used for any of frame pieces 126, 128, 130 and 132. For example, frame piece 400 may be an E-type extrusion comprising any of a plurality of materials, for example, polymers, aluminum, steel, other metals and alloys or combinations thereof. An E-type extrusion may be chosen for its strength relative to other types of frame pieces and for the fastening options provided by E-type extrusions.

Frame piece 400 may include a spine portion 402 that has a length 403 and thickness 404, for example, 2¼ inches and ¼ inches, respectively. The length 403 of the spine portion 402 may define the thickness 120 of backboard 102.

The frame piece 400 may include legs 406, 412 and 418. Leg 406 has a height 408 and a width 410, for example, 1¼ inches and ¼ inches, respectively. Leg 412 has a length 414 and a width 416, for example, 2¼ inches and /1;4 inches, respectively. Leg 418 has a length 420 and a width 422, for example, 1¾ inches and ⅛ inches, respectively.

Spine 402 and legs 406 and 412 thus may define a region having a thickness equal to distance 424, a height equal to height 408 and a length equal to the length of frame piece 400. The dimensions of this region may be configured such that a sheet of material, e.g., perforated, polymer sheet 106, may be inserted therein, and configured to allow room for other materials to be inserted along with a sheet of material, as described above with respect to FIGS. 4A-4C. In an embodiment, the distance 424 may be 1 1/16 inches.

Legs 412 and 418 may be configured to be separated by a distance 426, for example, ⅝ inches. Legs 412 and 418 and spine 402 thus define a region having a width equal to the distance 426, a height 420 and a length equal to the length of the frame piece 400. This region may be used for any of a plurality of regions, for example, for installing one or more support systems for backboard 102.

Having now described some illustrative embodiments of the invention, it should be apparent to those skilled in the art that the foregoing is merely illustrative and not limiting, having been presented by way of example only. Numerous modifications and other illustrative embodiments are within the scope of one of ordinary skill in the art and are contemplated as falling within the scope of the invention. In particular, although many of the examples presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments. Further, for the one or more means-plus-function limitations recited in the following claims, the means are not intended to be limited to the means disclosed herein for performing the recited function, but are intended to cover in scope any means, known now or later developed, for performing the recited function.

As used herein, "plurality" means two or more. As used herein, all transitional phrases such as "comprising", "including", "carrying", "having", "containing", "involving", and the like are to be understood to be open-ended, i.e., to mean including but not limited to. Only the transitional phrases "consisting of" and "consisting essentially of", respectively, shall be closed or semi-closed transitional phrases as set forth in the United States Patent Office Manual of Patent Examining Procedures (Original Eighth Edition, August, 2001) Section 2111.03.

Also in the claims, use of ordinal terms such as "first", "second", "third", etc., to modify a claim element do not by themselves connote any priority, precedence, or order of one claim element over another or the temporal order in which acts of a method are performed, but are used merely as labels to distinguish one claim element having a certain name from another element having a same name but for use of the ordinal term to make the names different.

What is claimed is:

1. A method of making a basketball goal assembly, comprising acts of:

(A) providing a basketball backboard comprising a polymer sheet configured and arranged to serve as a basketball backboard and having dimensions making the basketball backboard suitable for official basketball league use, the polymer sheet including a plurality of voids in a region of the polymer sheet that reduce a bounce characteristic of the region as compared to a bounce characteristic of an otherwise identical region of a polymer sheet having no voids, wherein none of the plurality of voids are for affixing a basketball rim or a support mechanism to the polymer sheet;

(B) affixing a rim to the basketball backboard;

(C) mounting the basketball backboard on a support mechanism; and (D) mounting the backboard as part of a basketball court housed indoors.

2. The method of claim 1, further comprising:

(D) configuring the polymer sheet to have at least two distinct regions that have different bounce characteristics.

3. The method of claim 2, further comprising:

(D) configuring the polymer sheet to have at least three distinct regions, including: a region on a left side of the polymer sheet that includes one or more of the plurality of voids, a region on a right side of the polymer sheet that includes one or more of the plurality of voids, and a region along a center of the polymer sheet that does not include any voids.

4. The method of claim 1, wherein the polymer sheet comprises polycarbonate.

5. The method of claim 1, further comprising:

(D) creating one or more of the voids as perforations that extend from a front surface of the polymer sheet to a back surface of the polymer sheet.

6. The method of claim 1, further comprising:

(D) arranging the voids in a two-dimensional diagonal pattern.

7. The method of claim 1, further comprising:

(D) configuring a front surface of the polymer sheet to have an area of at least three square-feet.

8. The method of claim 1, wherein the act (D) comprises affixing the basketball goal assembly to an interior surface of an indoor facility.

9. The method of claim 8, wherein the interior surface is a wall of the indoor facility.

10. A basketball court located indoors, comprising:

a basketball backboard including a sheet of polymer material having a plurality of voids in a region of the polymer sheet, none of which are for affixing a rim or a support mechanism to the polymer sheet, where the voids reduce a bounce characteristic of the region of the polymer sheet as compared to a bounce characteristic of an otherwise identical region of a polymer sheet having no voids;

a basketball rim affixed to the basketball backboard; and a support mechanism on which the basketball backboard is mounted, wherein the basketball court is adequately protected from naturally occurring wind.

11. The basketball court of claim 10, wherein the sheet comprises a polymer.

12. The basketball court of claim 11, wherein the sheet comprises polycarbonate.

13. The basketball court of claim 10, wherein a ratio of total volume of the one or more voids within the region to the volume of the polymer within the region is in a range from approximately 0.01 to 0.3.

14. The basketball court of claim 10, wherein the sheet has at least two distinct regions that have different bounce characteristics.

15. The basketball court of claim 14, wherein the sheet has at least three distinct regions, including: a region on a left side of the sheet that includes one or more of the plurality of voids, a region on a right side of the sheet that includes one or more of the plurality of voids, and a region along a center of the sheet that does not include any voids.

16. The basketball court of claim 14, wherein the basketball backboard is affixed to a rim, and wherein the sheet is configured such that a bounce characteristic of each region of the sheet is a function of a distance of the region from the rim.

17. The basketball court of claim 10, wherein one or more of the voids are perforations extending from a front surface of the sheet to a back surface of the sheet.

18. The basketball court of claim 17, wherein one or more of the perforations are cylindrical.

19. The basketball court of claim 10, wherein the voids are arranged in a two-dimensional diagonal pattern.

20. The basketball court of claim 10, wherein a front surface of the sheet has an area of at least three square-feet.

21. The basketball court of claim 10, wherein the sheet has a front surface that is a front surface of the backboard and a back surface that is a back surface of the backboard.

22. The basketball court of claim 10, wherein the support mechanism is affixed to an interior surface of an indoor facility.

23. The basketball court of claim 9, wherein the interior surface is a wall of the indoor facility.

24. The basketball court of claim 10, wherein the support mechanism is configured exclusively for mounting the basketball goal assembly indoors.

* * * * *